US006885351B1

(12) United States Patent
Bohlman

(10) Patent No.: US 6,885,351 B1
(45) Date of Patent: Apr. 26, 2005

(54) ANTENNA

(75) Inventor: Walter Bohlman, Berlin, MD (US)

(73) Assignee: BAE Systems Aerospace Electronics, Inc., Lansdale, PA (US)

( * ) Notice: Subject to any disclaimer, the term of this patent is extended or adjusted under 35 U.S.C. 154(b) by 94 days.

(21) Appl. No.: 10/627,036

(22) Filed: Jul. 24, 2003

(51) Int. Cl.[7] ..... H01Q 9/04
(52) U.S. Cl. ..... 343/793; 343/820
(58) Field of Search ..... 343/793, 820, 343/821, 846, 749, 750, 751, 752, 745, 753

(56) References Cited

U.S. PATENT DOCUMENTS 3,099,836 A 7/1963 Carr
3,935,577 A * 1/1976 Hansen ..... 343/781 R
4,568,944 A * 2/1986 Cassel ..... 343/802
4,931,808 A * 6/1990 Lalezari et al. ..... 343/753
5,959,591 A * 9/1999 Aurand ..... 343/786
6,492,953 B2 12/2002 Apostolos

* cited by examiner

*Primary Examiner*—Don Wong
*Assistant Examiner*—Huedung X. Cao
(74) *Attorney, Agent, or Firm*—Drinker Biddle & Reath LLP

(57) ABSTRACT

An antenna with first and second spaced radiating elements extending from a vertex at respective first ends and diverging from each other in a direction outward from the vertex to respective second ends. Each radiating element second end is connected to a first end of a terminating element through a coupler. The second end of each terminating element is connected to a common ground plane.

20 Claims, 4 Drawing Sheets

ANTENNA

FIELD OF THE INVENTION

The present invention pertains to antennas and, in particular, broadband antennas with improved low-frequency performance.

BACKGROUND OF THE INVENTION

Antennas are widely used in electronic communication, and devices that rely on antennas for communication are simultaneously becoming more complex and more compact. Space for antennas is, therefore, becoming problematic, and designers are constantly looking for ways to improve the frequency range and minimize or reduce the size of antennas. A goal of designers is to achieve broadband performance in a small package.

So-called V-strip antennas, such as that disclosed in U.S. Pat. No. 3,099,836, are often used where broadband performance and small size are desired. However, the low-frequency performance of such antennas has been limited.

There is therefore a need for an antenna with excellent low-frequency performance and of small size. The present invention meets that need.

SUMMARY OF THE INVENTION

In its broad aspects, the invention encompasses an antenna having first and second spaced radiating elements extending from a vertex at respective first ends and diverging from each other in a direction outward from the vertex to respective second ends. Each radiating element second end is connected to a first end of a terminating element through a coupler. The second end of each terminating element is connected to a common ground plane.

In another aspect, the invention is directed to an antenna assembly comprising a pair of antennas arranged to radiate and receive energy in mutually orthogonal directions. Each antenna comprises first and second spaced radiating elements extending from a common vertex region at respective first ends and diverging from each other in a direction outward from the vertex to respective second ends. Each radiating element second end is connected to a first end of a terminating element through a coupler. The second end of each terminating element is connected to a common ground plane. Each antenna is excited independently of the other.

In yet another aspect, the invention comprehends an antenna system comprising radiating element means for radiating and receiving electromagnetic energy across a desired frequency range, the radiating element means including conductive strips diverging outwardly from a common vertex region, means for exciting the radiating element means, means for terminating the radiating element means at a common ground plane, and means for coupling the radiating means to the terminating means.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE INVENTION

Figure 1A:
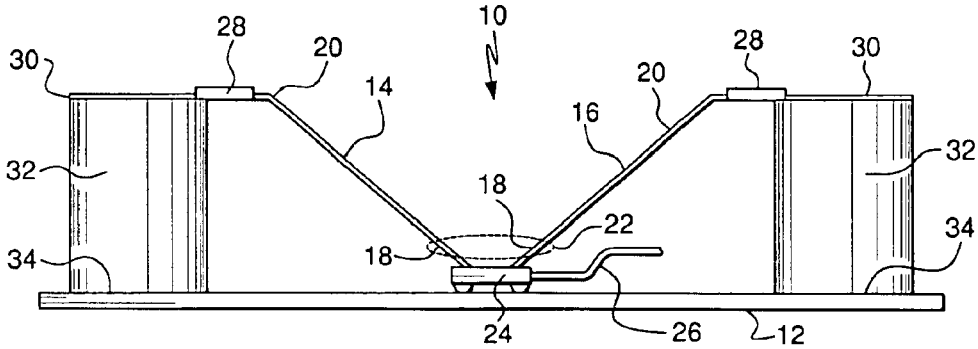
FIGS. 1A and 1B are side elevation views of one embodiment of an antenna constructed according to the invention, in which the radiating elements are solid conductors.
Figure 1B:
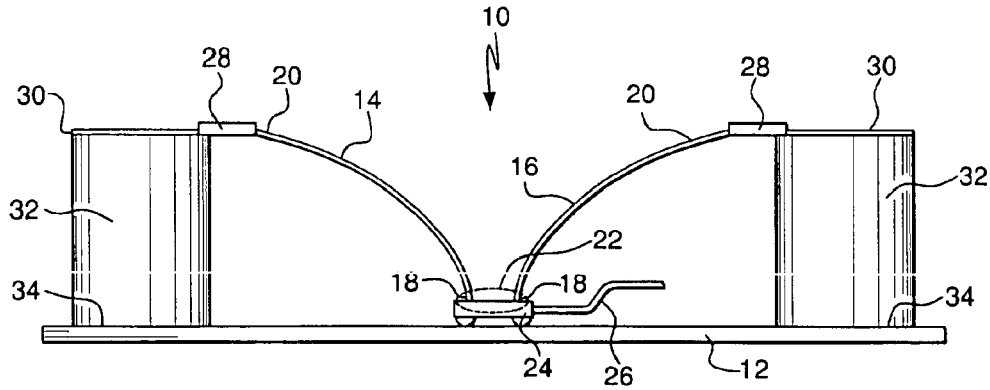

Referring now to the drawings, wherein like reference numerals indicate like elements, there is shown in FIG. 1A a side elevation view of one embodiment of an antenna 10 constructed according to the invention. The antenna 10 comprises a ground plane 12, and two radiating elements 14 and 16 arranged in a V configuration. Each radiating element 14, 16 comprises a conductive strip having a first end 18 and a second end 20. The respective first ends 18 of radiating elements 14, 16 are located adjacent each other at a vertex region 22, and extend outwardly from the vertex region. The radiating elements 14, 16 diverge from each other (i.e., the distance between them increases) in a direction away from the vertex region 22, and form a structure that, in the side elevation view, is generally V-shaped. As can be seen from a comparison of FIGS. 1A and 1B, the spacing between the radiating elements 14, 16 may increase either linearly in the direction outward from the vertex 22, or non-linearly in the direction outward from the vertex.

Figure 2A:
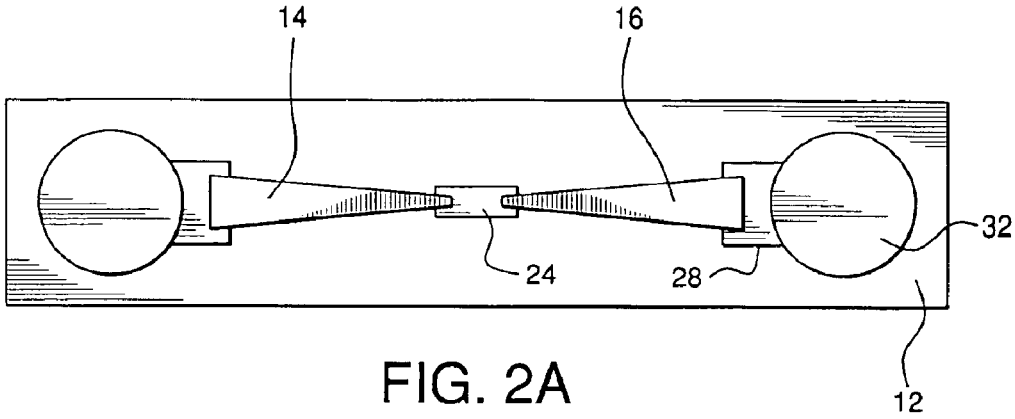
FIG. 2A is a top plan view of the antenna shown in FIG. 1A.
Figure 2B:
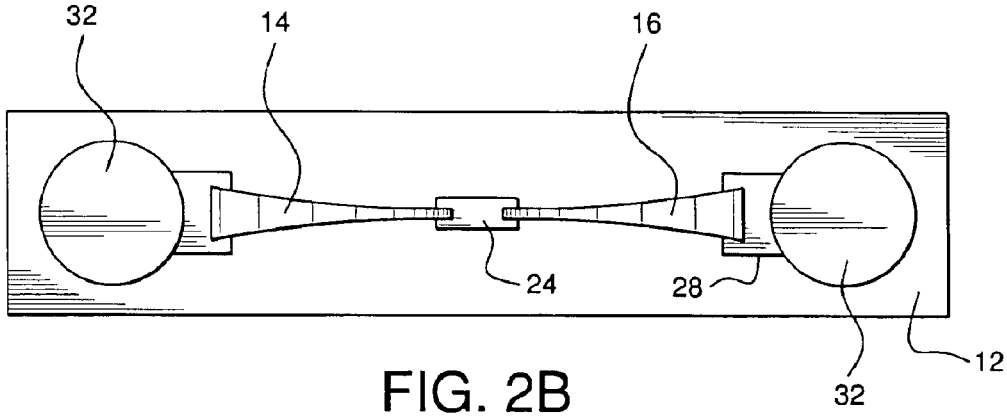
FIG. 2B is also a top plan view of the antenna shown in FIG. 1A, showing an alternative shape of the antenna radiating elements.

As best seen in FIGS. 2A and 2B, the width of the conductive strips that form radiating elements 14, 16 is not constant from the vertex region 22 to their respective second ends 20, but increases in the direction of divergence. That is, as one moves outward from the vertex region 22 toward their second ends 20, radiating elements 14, 16 both diverge from each other and become wider. As can be seen by comparing FIG. 2A with FIG. 2B, the width can increase either linearly or non-linearly.

The respective first ends of the radiating elements 14, 16 are connected in the vertex region 22 to a balun 24, which provides energy to be radiated from and receives energy received by radiating elements 14, 16. Balun 24 is preferably located relative to ground plane 12 so that it is not in electrical contact with the ground plane. For example, balun 24 may be mounted on an insulator that is physically in contact with the ground plane but that electrically isolates balun 24 from the ground plane. Other ways of mounting balun 24 may also be used without departing from the invention. Balun 24 provides a balanced feed arrangement to the radiating elements 14, 16. Balun 24 can be any one of many standard forms. In addition, an infinite balun could be used in conjunction with a meander line coupler (described more fully below). The use of a balun to convert excitation signals to a balanced feed is known in the art, and its design for use in connection with the antenna 10 will be clearly understood to those skilled in the art. Energy to be radiated from or received by antenna 10 is typically supplied to and conveyed from balun 24 by a coaxial cable 26. The impedance of balun 24 is chosen in conjunction with the input impedance of the radiating elements 14, 16 and the characteristic impedance of the coaxial cable 26 so that the voltage standing wave ratio (VSWR) is made as small as possible over the operating frequency band of the antenna.

The respective second ends 20 of radiating elements 14, 16 are each connected to a coupler 28, which, in turn, is connected to a first end 30 of a terminating element 32. Terminating element 32 is conductive and is connected at a second end 34 to the ground plane 12. The shape of terminating element 32, while illustrated as circular in cross-section, is not critical. The terminating element 32 can be a cylinder, either solid or hollow, or can be simply a flat strip of conductive material shaped to support coupler 28 and provide electrical connection to the ground plane 12. Preferably, the height of terminating element 32 above the ground plane 12 is less than or equal to one-quarter wavelength (¼λ).

Figure 2C:
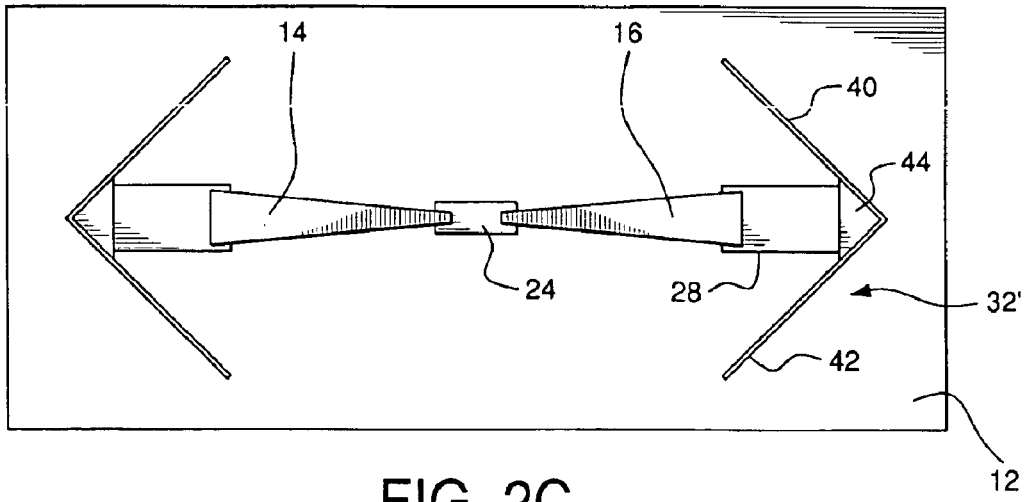
FIG. 2C is a top plan view of the antenna shown in FIG. 1A, showing an alternate form of the antenna terminating elements.

FIG. 2C illustrates an alternative form of terminating element. While the alternative form is illustrated in connection with a single polarized antenna, it should be understood that the alternative form of terminating element illustrated in FIG. 2C can be used with dual polarized antennas as well as single antennas. In FIG. 2C, terminating element 32' is in the form of an angle, rather than a cylinder, and has two upright side walls 40, 42 arranged at right angles to each other. At the top of each side wall 40, 42 is a land area 44. Land area 44 receives one end of coupler 28, in the same fashion as cylindrical terminating element 32.

Coupler 28 provides both impedance matching and filtering between the radiating structures. Coupler 28 is preferably a reactive coupler, and can be a simple capacitor, a series or parallel LC network, or can be a more complex reactive element such as a meander line. Meander line reactive elements are known, and one form of meander line is illustrated in U.S. Pat. No. 6,492,953, assigned to BAE Systems Information and Electronic Systems Integration Inc. A meander line coupler would tend to prevent high frequency currents from exciting the terminating elements 32. If the terminating elements 32 were excited in the high-frequency portion of the operating band, the radiation pattern would tend to be wider in the E plane. As already noted, where a meander line coupler is used, an infinite balun 24 may be used.

Electrically, the radiating elements 14, 16, the couplers 28, terminating elements 32, and ground plane 12 comprise a continuous electrical path in the form of a closed loop from the first end 18 of radiating element 14 to the first end 18 of radiating element 16. All of the connections between the elements of the antenna can be made using conventional methods and materials, taking into consideration the frequency of operation, the operating environment, and the like. However, it is preferred that all connections introduce little or no inductance into the circuit.

The antenna of the invention provides improved low-frequency performance and extends the low frequency of operation by at least an octave. The antenna can also be made quite small. Previous antennas, such as conventional V-strip antennas like that disclosed in U.S. Pat. No. 3,099,836, have a length from the vertex 12 to the free ends of the metal strips of about half a wavelength (λ/2) at the low-frequency end of operation. In contrast, the antenna of the present invention is about two-tenths of a wavelength (0.2 λ) across (from one terminating element to the other) and about one-tenth of a wavelength (0.1 λ) high (from the ground plane to the top of the terminating elements) at the low-frequency end of its operating range.

Figure 3:
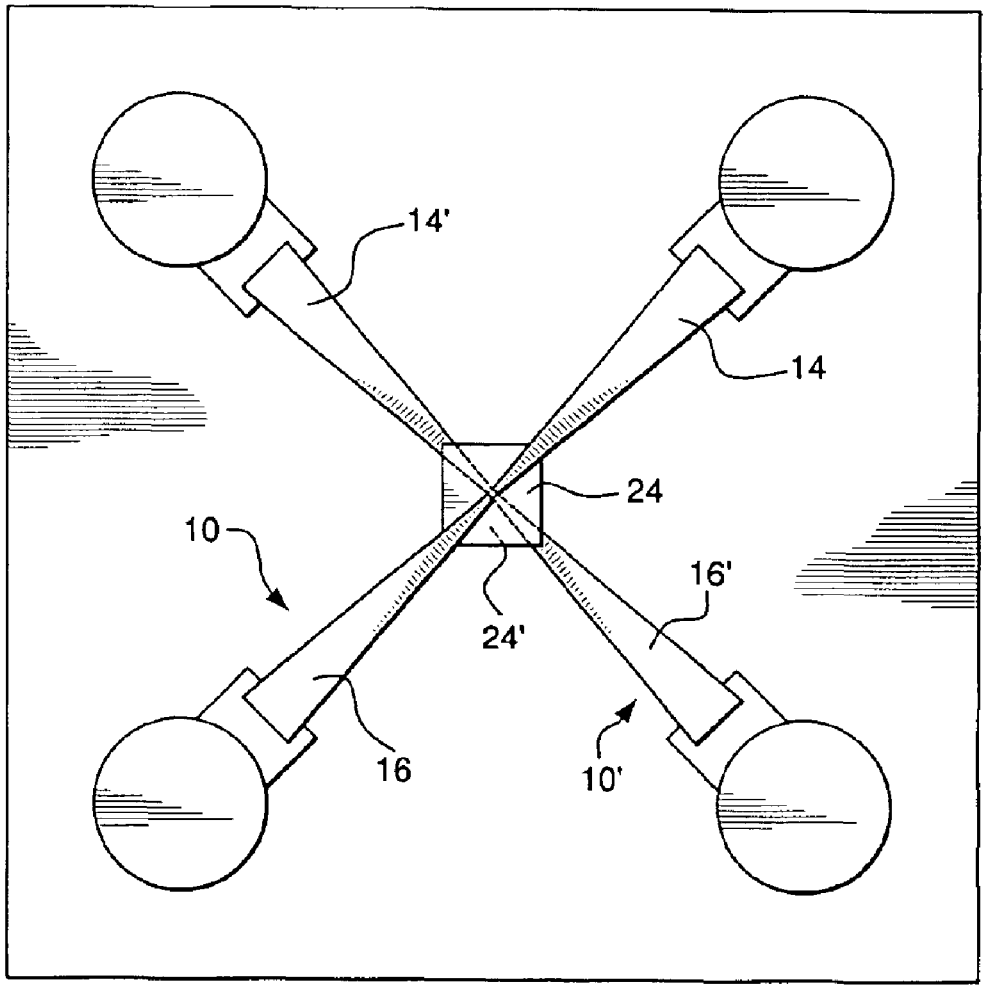
FIG. 3 is a top plan view of a dual antenna, showing two single antennas arranged in an orthogonal overlapping configuration.

Two antennas as just described may be "crossed," i.e., arranged in an orthogonal overlapping configuration, to provide dual orthogonal linear polarization. This arrangement is illustrated in FIG. 3, which is a top plan view of a dual polarized antenna according to the invention. All of the individual elements are as already described. Radiating elements 14, 16 of one individual antenna 10 and radiating elements 14', 16' of the other individual antenna 10' are overlapped and placed at right angles to one another. Balun 24 of the one antenna and balun 24' of the other antenna are "stacked," one atop the other, at the center. As those skilled in the art will appreciate, the topmost balun must be spaced from the bottom balun, which can be readily accomplished using known construction and fabrication techniques. With the arrangement, each individual antenna 10, 10' radiates or receives energy in a highly linear direction orthogonal to the other. This provides dual polarization performance and enables the antenna to radiate or receive energy in mutually orthogonal directions.

Figure 4A:
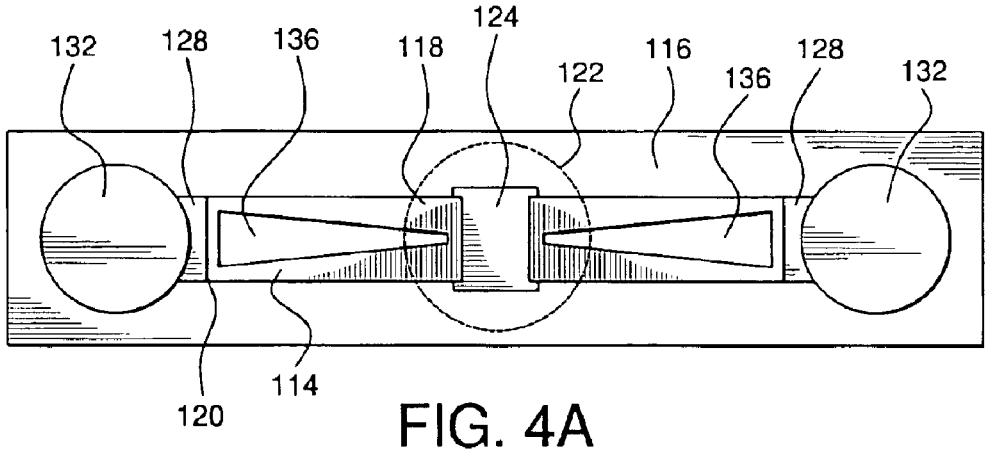
FIGS. 4A and 4B are top plan views of an alternative embodiment of an antenna constructed according to the invention, in which the radiating elements comprise slots.
Figure 4B:
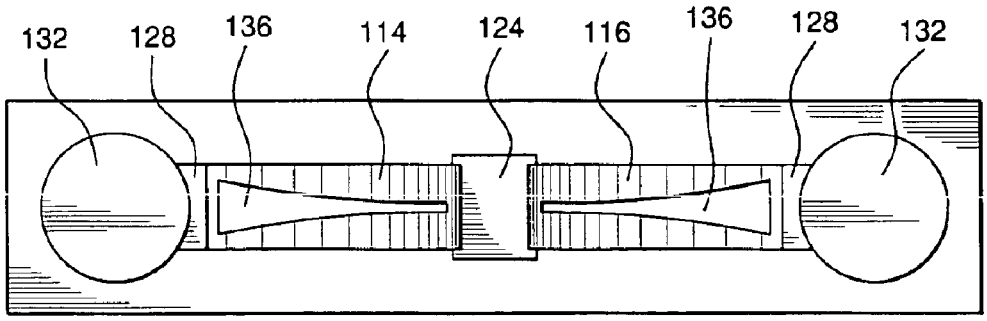

In an alternative embodiment 100 of the invention, the radiating elements can be slots instead of conductive strips. As shown in FIGS. 4A and 4B, each radiating element comprises a conductive strip 114, 116 of fixed width arranged in a V-configuration, as described previously. That is, the respective first ends 118 of strips 114, 116 are located adjacent each other at a vertex region 122, and extend outwardly from the vertex region to couplers 128 and terminating elements 132, in the same manner as in the previously described embodiment. Also as in the previously described embodiment, the strips 114, 116 diverge from each other (i.e., the distance between them increases) in a direction away from the vertex region 122, and form a structure that, in the side elevation view, is generally V-shaped. However, unlike the previously described embodiment, in this embodiment the width of the conductive strips that form radiating elements 114, 116 remains constant from the vertex region 122 to their respective second ends 120.

In each conductive strip 114, 116 is a slot 136. As seen in FIGS. 4A and 4B, the width of slot 136 (measured in a direction orthogonal to the imaginary line connecting first end 118 and second end 120) increases as one moves outward from vertex region 122 to second end 120. The width of the slot may increase either linearly in the direction outward from the vertex, as shown in FIG. 4A, or may increase non-linearly in the direction outward from the vertex, as shown in FIG. 4B. In either form, the conductive strips are connected to a balun 124 and the slots are excited by the balun.

As is known in the art, with this arrangement the slots 136, and not the conductive strips 114, 116, act as the radiating elements. The construction, operation, and performance of the antenna are, however, otherwise the same. As those skilled in the art will understand, two slot antennas may also be crossed to provide dual orthogonal linear polarization. In addition, a slot antenna may be crossed with a solid conductor antenna, if desired.

The foregoing describes the invention in terms of embodiments foreseen by the inventor for which an enabling description was available, notwithstanding that insubstantial modifications of the invention, not presently foreseen, may nonetheless represent equivalents thereto. The present invention may be embodied in other specific forms without departing from the spirit or essential attributes thereof and, accordingly, reference should be made to the appended claims, rather than to the foregoing specification, as indicating the scope of the invention.

What is claimed is:

1. An antenna, comprising first and second spaced radiating elements extending from a vertex at respective first ends and diverging from each other in a direction outward from the vertex to respective second ends, each radiating element second end being connected to a first end of a terminating element through a coupler, the second end of each terminating element being connected to a common ground plane.

2. The antenna of claim 1, further comprising a balun connected to the radiating element respective first ends.

3. The antenna of claim 1, wherein the coupler comprises a reactive circuit element.

4. The antenna of claim 3, wherein the reactive circuit element is a series capacitor.

5. The antenna of claim 3, wherein the reactive circuit element is a meander line.

6. The antenna of claim 1, wherein the spacing between the radiating elements increases linearly in the direction outward from the vertex.

7. The antenna of claim 1, wherein the spacing between the radiating elements increases non-linearly in the direction outward from the vertex.

8. The antenna of claim 1, wherein the radiating elements are solid conductors.

9. The antenna of claim 1, wherein the radiating elements are radiating slots in a solid conductor.

10. An antenna assembly, comprising a pair of antennas arranged to radiate and receive energy in mutually orthogonal directions, each antenna comprising first and second spaced radiating elements extending from a common vertex region at respective first ends and diverging from each other in a direction outward from the vertex to respective second ends, each radiating element second end being connected to a first end of a terminating element through a coupler, the second end of each terminating element being connected to a common ground plane, each antenna being excited independently of the other.

11. The antenna assembly of claim 10, wherein each antenna is excited by its own balun connected to the respective first ends of the radiating elements of said antenna.

12. The antenna assembly of claim 10, wherein each coupler is a reactive circuit element comprising a selected one of a capacitor and a meander line.

13. The antenna assembly of claim 10, wherein the radiating elements of each antenna selectably comprise one of a solid conductor and radiating slots in a solid conductor.

14. An antenna system, comprising radiating element means for radiating and receiving electromagnetic energy across a desired frequency range, the radiating element means including conductive strips diverging outwardly from a common vertex region, means for exciting the radiating element means, means for terminating the radiating element means at a common ground plane, and means for coupling the radiating means to the terminating means.

15. The antenna system of claim 14, comprising a pair of radiating element means arranged in a V-shaped configuration, said pair of radiating element means being excited by a common exciting means.

16. The antenna system of claim 14, comprising four radiating element means arranged in quadrature to define mutually orthogonal pairs of radiating element means arranged in a V-shaped configuration, each mutually orthogonal pair of radiating element means being excited by an exciting means.

17. The antenna system of claim 14, wherein the radiating element means are solid conductors.

18. The antenna system of claim 14, wherein the radiating element means are slots.

19. The antenna system of claim 14, wherein the means for exciting the radiating element means comprises a balun.

20. The antenna system of claim 14, wherein the means for coupling the radiating means to the terminating means comprises a reactive circuit element.

* * * * *